US005189231A

United States Patent [19]

Canova et al.

[11] Patent Number: 5,189,231

[45] Date of Patent: Feb. 23, 1993

[54] COMPOSITIONS OF LIQUID HYDROCARBONS FROM REFINING ENDOWED WITH IMPROVED BEHAVIOR AT LOW TEMPERATURES

[75] Inventors: Luciano Canova, Novara; Ettore Santoro, Milan; Luciano Bonoli, Novara; Paolo Falchi, Chieti, all of Italy

[73] Assignee: Societa' Italiana Additivi Per Carburanti s.r.l., Pescara, Italy

[21] Appl. No.: 692,872

[22] Filed: Apr. 29, 1991

[30] Foreign Application Priority Data

Apr. 30, 1990 [IT] Italy ..... 20179 A/90

[51] Int. Cl.[5] ..... C07C 7/20

[52] U.S. Cl. ..... 585/4; 585/1; 585/2; 585/3

[58] Field of Search ..... 585/1, 2, 3, 4

[56] References Cited

U.S. PATENT DOCUMENTS

| | | | |
|---|---|---|---|
| 2,892,690 | 6/1959 | Lowe et al. . | |
| 3,853,497 | 12/1974 | Miller et al. | 585/4 |
| 4,290,925 | 9/1981 | Pennewiss et al. | 585/4 |
| 4,677,151 | 6/1987 | Pennewiss et al. | 585/3 |
| 4,922,045 | 5/1990 | White et al. | 585/3 |

FOREIGN PATENT DOCUMENTS

| | | |
|---|---|---|
| 0172758 | 2/1986 | European Pat. Off. . |
| 0315151 | 5/1989 | European Pat. Off. . |
| 0331052 | 9/1989 | European Pat. Off. . |
| 0350072 | 1/1990 | European Pat. Off. . |
| 0354407 | 2/1990 | European Pat. Off. . |
| 0376747 | 7/1990 | European Pat. Off. . |
| 2528435 | 12/1983 | France . |
| 1593672 | 7/1981 | United Kingdom . |

*Primary Examiner*—Asok Pal

*Attorney, Agent, or Firm*—Morgan & Finnegan

[57] ABSTRACT

The filter plugging point and the pour-point at low temperatures of compositions based on liquid hydrocarbons from refining are improved by means of the addition, preferably in solution, of a mixture of an ethylene copolymer with another copolymerizable monomer and of an imidized acrylic polymer.

21 Claims, No Drawings

COMPOSITIONS OF LIQUID HYDROCARBONS FROM REFINING ENDOWED WITH IMPROVED BEHAVIOR AT LOW TEMPERATURES

FIELD OF THE INVENTION

The present invention relates to compositions of liquid hydrocarbons from refining endowed with improved behavior at low temperatures.

By the term liquid hydrocarbons from refining, as used in the present description and in the claims, it is meant gas oils, fuel oils in general and, from a more general standpoint, the products known as the "middle distillates" which, with decreasing temperature, show undesired alterations in their physical properties, they be detected, e.g., by measurements of the following parameters: the pour point (P.P.) and the cold filter plugging point (C.F.F.P.), as respectively defined in ASTM D97-66 and IP 309/83 standards.

BACKGROUND OF THE INVENTION

It is known, for example, that the gas oils used for automobile, naval and aeronautical internal combustion engine feeding or for heat generation purposes, become less fluid with decreasing temperature. This causes serious drawbacks in their use.

Such a phenomenon is mainly due to the precipitation of n-paraffins contained in the gas oil.

It is also known to obviate such a drawback by adding suitable substances, generally of polymeric type to the above said liquid hydrocarbons from refining.

The additives commonly used for such a purpose are represented by:

ethylene-vinyl acetate copolymers having suitable molecular weight values and compositions, as disclosed, for example, by U.S. Pat. Nos. 3,048,479; 3,087,894; 3,093,623; 3,126,364; 3,159,608; 3,250,714; 3,627,839; etc.;

oil-soluble polymeric N-aliphatic acrylamides having a molecular weight of at least 1,000 in which the aliphatic groups contain an open chain of at least 8 C with not more than 2 are atoms of oxygen or sulfur and the rest are carbon atoms, as disclosed by U.S. Pat. No. 2,387,501;

ethylene-propylene-(non-conjugated diene) copolymers or terpolymers, prepared with homogeneous-phase catalysts (based on vanadium compound and organometallic aluminum compounds), as disclosed by Italian Patent Nos. 811,873 and 866,519;

ethylene-propylene-conjugated or non-conjugated diene terpolymers, which are prepared with homogeneous-phase catalysts and are subsequently degraded by thermooxidation until suitable values of molecular weight are reached, as disclosed by U.S. Pat. Nos. 3,374,073 and 3,756,954.

All the above additives are satisfactory from the standpoint of lowering the pour point of the liquid hydrocarbons and in some cases the cloud point (C.P.) too, namely the temperature value at which the first paraffin crystals appear. But they do not sufficiently control the crystallization kinetics and the size and the shape of the paraffin crystals occurring by cooling.

DESCRIPTION OF THE INVENTION

It has been now found by applicants that a synergistic effect, as far as the decreasing both of the pour point and of the cold filter plugging point of the hydrocarbons are concerned, is obtained by incorporating into the liquid hydrocarbons a mixture of an ethylene copolymer with at least another copolymerizable monomer and of an imidized acrylic polymer.

The subject matter of the present invention is, therefore, a composition based on liquid hydrocarbons from refining, endowed with improved filter plugging point at low temperatures, such as, for example, at −40° C., containing incorporated therein from 0.005 to 1% by weight of a mixture comprising:

(i) an ethylene copolymer with at least an other copolymerizable monomer, and (ii) an imidized acrylic polymer.

The ratio between the two components of the mixture is not critical for the object of the present invention; even if ethylene copolymer/imidized acrylic polymer weight ratio comprised between 0.1 and 10, preferably between 0.25 and 4, are generally used.

The component (i) of the synergistic mixture of the present invention is an ethylene copolymer with at least another copolymerizable monomer having a ethylene content between 1 and 99% by moles.

Examples of said ethylene copolymers are:

the oil-soluble copolymers constituted by ethylene and an $C_3$–$C_{18}$ alpha-olefin, such as, for example, ethylene-propylene copolymer;

the oil-soluble terpolymers constituted by ethylene, $C_3$–$C_{18}$ alpha olefin and an aliphatic or cycloaliphatic diene, such as, for example, ethylene-propylenemethylene-norbornene terpolymer, ethylene-propylene-5-ethylidene-2-norbornene terpolymer, ethylene-propylene-1,4-exadiene terpolymer, ethylene-propylene-dicyclopentadiene terpolymer, ethylene-propylene-butadiene terpolymer;

ethylene-$C_3$–$C_{18}$ alpha olefin copolymer or ethylene-alpha olefin-diene degraded and oxidized by treatment with oxygen or with a oxygen containing gas at a temperature higher than 100° C., these being optionally reduced;

the copolymers containing ethylene and at least a polar monomer, such as an unsaturated acid, an unsaturated anhydride or a mono- or di-ester of an unsaturated acid having the formula:

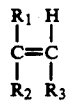

(I)

wherein $R_1$ is hydrogen or methyl, $R_2$ is an-$OOCR_4$ —$COOR_4$ radical wherein $R_4$ is hydrogen or an $C_1$–$C_{16}$, preferably $C_1$–$C_4$, straight or branched alkyl radical, and $R_3$ is hydrogen or a —COO—$R_4$ radical, $R_4$ having the above reported meaning;

The terpolymers containing 35–98% of ethylene, 1–5% of propylene and 1–60% of an alkyl ester of acrylic or methacrylic acid having from 1 to 12 C in the alkyl chain;

The reaction products of the maleic anhydride and a ethylene-propylene-diene terpolymer and the like.

All the above ethylene copolymers are well known in literature as suitable flow improvers for the liquid hydrocarbons and disclosed, for example, by Italian Patent Nos. 811,873 and 866,519; by U.S. Pat. Nos. 3,037,850; 3,048,079; 3,069,245; 3,093,623; 3,126,364; 3,236,612; 3,374,073; 3,388,977; 3,507,636; 3,691,078; 4,087,255 and by Canadian Patent No. 676,875. The contents of these patents are incorporated in the present description by as reference.

The ethylene-propylene copolymers and the terpolymers of such monomers with a conjugated diene structurally characterized by the substantial absence in their polymeric chain of inversions in propylene linking pattern (also known as propylene "head—head", "tail—tail" inversions), are particularly preferred in the compositions of the present invention.

By "inversion in propylene linking pattern", the change in insertion modality (from primary to secondary) which the molecule of propylene may show in the macromolecule is herein meant.

Said copolymers and terpolymers are characterized by very low values of absorption in $^{13}$C-NMR spectrum (obtained in solution in ortho-dichlorobenzene at the temperature of 120° C., by using dimethylsulphoxide (DMSO) as the external reference) at about 34.9; 35.7 and 27.9 p.p.m. (chemical shift, referred to tetramethylsilane (TMS)=0), typical of the presence of sequences of type:

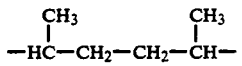

(head—head or tail—tail inversion of $X_2$ type); and of type:

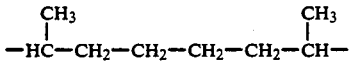

(head—head or tail—tail inversion of $X_4$ type).

The substantial absence of propylene linking inversions in such copolymers and terpolymers is expressed by the fact that at least either of $X_2$ and $X_4$ parameters, and preferably both of them, have a value equal to, or smaller than, about 0.02.

As it is known, $X_2$ and $X_4$ parameters represent the fraction of methylenic sequences containing uninterrupted sequences of respectively 2 and 4 methylene groups between two successive methyl or methyne groups in the polymeric chain, as computed relatively to the total of the uninterrupted sequences of methylene groups, as determined by means of $^{13}$C-NMR. The value of such a fraction is computed according to the method as described by J. C. Randall in "Macromolecules" 11, 33 (1978).

Among the ethylene copolymers and terpolymers endowed with such a feature, those containing from 20 to 55%, and preferably from 25 to 45% by weight of propylene, and from 0 to 10%, and preferably from 1 to 7% by weight of monomeric units deriving from a conjugated diolefin, can be advantageously used as additives.

The preferred copolymers and terpolymers have a viscosimetric molecular weight (Mw) comprised within the range of from 1,000 to 200,000, and preferably within the range of from 3,000 to 150,000.

According to a further preferred aspect of the present invention, the above disclosed copolymers and terpolymers are submitted to a thermo-oxidative, degradation before being used as additives.

Such a degradation can be carried out according to known techniques, e.g., by heating the polymer with oxygen or with an oxygen-containing gas, at temperatures of at least 100° C., and up to 400° C., preferably comprised within the range of from 300° to 350° C., for a long enough time for reducing the (viscosimetric) molecular weight to a range comprised from 1000 to a value 5% lower than the original molecular weight value. The so-oxidized polymer has a content of >C=O groups comprised within the range of from 0 to 10 per each 1,000 carbon atoms, as determined by I.R.-spectroscopy.

The degradation of the polymer can be advantageously and preferably carried out inside extruders or similar devices, with the optional addition of degrading substances, such as a peroxide, or of polymer-modifying substances, such as, e.g., amines. The degradation of the polymer can be also carried out in solution, according to routes well known in the art.

The ethylene copolymer or terpolymer containing at least one, and preferably both $X_2$ and $X_4$ parameters equal to, or lower than about 0.02, is particularly suitable.

These copolymers, terpolymers and the process for their preparation and thermo-oxidation are well known in the art and disclosed by the co-pending Italian Patent Application No. 21 281A/88 filed on Jul. 8, 1988 in the name of the same Applicant, the content of which is incorporated by reference in the present description .

The component (ii) of the synergistic mixture of the present invention is an imidized acrylic polymer, obtained by reaction of an acrylic polymer with a primary amine or a secondary amide.

As known, such polymers are characterized by the presence of imidic units of formula:

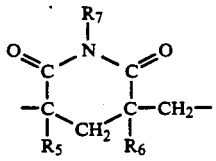

(IV)

wherein:

$R_5$ and $R_6$, either equal to or different from each other, represent hydrogen or an alkyl, aryl, aryl-alkyl or alkylaryl radical containing from 1 to 20 carbon atoms;

$R_7$ represents an alkyl, cycloalkyl, aryl, arylalkyl or alkylaryl radical containing from 4 to 30 carbon atoms; $R_5$ and $R_6$ being derived from esters of acrylic or methacrylic acid and $R_7$ from a primary amine or a secondary amide.

By the term "acrylic polymers", as used in the present disclosure and in the claims, the homopolymers and copolymers of acrylic or methacrylic acid and their alkyl esters are meant, wherein the alkyl group contains from 1 to 20 and preferably from 1 to 8 carbon atoms.

Examples of esters of methacrylic acid or acrylic acid are: methyl methacrylate, ethyl methacrylate, isopropyl methacrylate, sec.-butyl methacrylate, tert.-butyl methacrylate, and the corresponding esters of acrylic acid.

The acrylic polymers can contain units deriving from other monomers containing double bonds, such as styrene, alpha-methyl-styrene, acrylonitrile, acrylamide, etc., or from monomers containing a double ethylenic unsaturation, such as, e.g., butadiene.

Said polymers, furthermore, have intrinsic viscosity values, determined in tetrahydrofuran (THF) at 30° C., comprised within the range of from 0.01 to 7 dl/g, preferably comprised within the range of from 0.2 to 2 dl/g.

The imidization of these acrylic polymers is carried out by reaction with a nitrogen containing compound, such as an alkyl-amine, preferably containing a number of carbon atoms higher than 4, such as dodecylamine, octylamine, tetradecylamine, hexadecylamine etc., or a compound having formula:

$$R_8—X—NHR_7 \quad (V)$$

wherein:

$R_8$ can be hydrogen or an alkyl, cycloalkyl, aryl or alkylaryl radical containing from 1 to 20 carbon atoms;

$R_7$ can be an alkyl, cycloalkyl, aryl, arylalkyl or alkylaryl radical containing from 4 to 30 carbon atoms; and X is a bifunctional radical selected from the group consisting of: —CO—, —CONH—, —OCO—, —$SO_2$—, —$C_6H_4SO_2$—.

The nitrogen containing compounds are used in amounts comprised within the range of from 5 to 80 mol % relatively to the acrylic monomer unit.

Examples of nitrogen containing compounds having the general formula (V) are: acetanilide, benzanilide, N-butyl formamide, N-octyl formamide, N-decyl formamide, N-dodecyl formamide, N-octadecyl formamide, N-butyl-acetamide, N-octyl acetamide, N-decyl acetamide, N-dodecyl acetamide, N-tetradecyl acetamide, N-hexadecyl acetamide, N-octadecyl acetamide, N-butyl benzamide, N-octyl benzamide, N-dodecyl benzamide, N-tetradecyl benzamide, N-hexadecyl benzamide, N-octadecyl benzamide.

The above imidized acrylic polymers and the processes for preparation are well known in the literature and disclosed, for example, in U.S. Pat. Nos. 2,146,209; 3,284,425; 4,246,374; G.B. Patent Nos. 926,629; 1.045,229; FR Patent No. 82 10164; DE Patent Nos. 1.077,872; 1.242,369; 1.247,517; 2.041,736 and 2.047,096 and in the published European patent applications 275,918; 315,149; 315,150; 315,151 and 331,052; the contents of the above patents and patent applications are hereby incorporated by reference in the present description.

The mixture of an ethylene copolymer (i) and an imidized acrylic polymer (ii) of the present invention is used for improving the filterability and for decreasing the pour point and the cloud point of liquid hydrocarbons from refining, obtained by distillation at a temperature comprised within the range of from about 120° C. to about 400° C., and which have a pour point (P.P.) comprised within the range of from +10° C. to −30° C. and a C.F.P.P. comprised within the range of from +10° C. to −25° C., such as, for example, gas oils, fuel oils etc.

The mixture of the ethylene copolymer (i) and of the imidized acrylic polymer (ii) is incorporated, in the liquid hydrocarbon in a concentration varying within the range of from 0.005 to 1% by weight relatively to the composition. The exact quantity depends on the type of hydrocarbon and on the required decreasing of the pour point and the cold filter plugging point.

To facilitate the addition of the mixture in the hydrocarbon, it is preferred preparing a concentrate solution containing from 5 to 70% by weight of the mixture in suitable solvents constituted by hydrocarbons and/or their blends, having an aromatic, paraffinic, naphthenic character, and so forth, such as, e.g., those known on the market under the trade name Solvesso 100, 150, 200, HAN, Shellsol R, AB, E, A, and so forth, Exsold, Isopar, and so forth.

The compositions according to the present invention can also contain other types of intimately mixed additives, such as anti-oxidant agents, basic detergents, corrosion inhibitors, rust inhibitors, and/or cloud-point depressants. The ethylene copolymers and the imidized acrylic polymer used according to the present invention are generally compatible with these additives.

Such additives can be directly added to the compositions, or they can be contained in the concentrated polymeric solution which is added to the hydrocarbon from refining.

EXAMPLES

The following examples are given in order to illustrate the finding according to the present invention, however, they have no limitative value.

The following polymers were used in the examples.

1 - ETHYLENE COPOLYMERS

| TYPE | COMPOSITION | $X_2$ | $X_4$ | MOLECULAR WEIGHT |
|---|---|---|---|---|
| 1.A(a) | 62% by weight of ethylene 38% by weight of propylene | 0.02 | 0.05 | 10,000 |
| 1.B(a) | 61% by weight of ethylene 38% by weight of propylene 1% by weight of butadiene | 0.02 | 0.01 | 15,000 |
| 1.C(a) | 64.1% by weight of ethylene 32.5% by weight of propylene 3.4% by weight of butadiene | 0.02 | 0.01 | 20,000 |
| 1.D(b) | 72% by weight of ethylene 28% by weight of propylene | 0.05 | 0.05 | 100,000 |
| 1.E(b) | 57% by weight of ethylene 43% by weight of propylene | 0.13 | 0.06 | 100,000 |
| 1.F | 77% by weight of ethylene 23% by weight of vinyl acetate | — | — | 34,000 |

(a) Prepared by using a heterogeneous-phase catalyst based on $TiCl_4$ supported on $MgCl_2$, and of tri-isobutyl-aluminum, as disclosed in the Italian patent application No. 20,203 A/81. The copolymers and terpolymers were submitted to a thermo-oxidative degradation at 320° C. for 1 min. inside a twin-screw Werner Pfleiderer extruder, as disclosed in example 6 of the Italian patent application No. 21 281 A/88.
(b) Prepared by means of a homogeneous-phase catalytic system based on $VoCl_3$ and $Al_2(C_2H_5)_3Cl_3$, as disclosed in Example 1 of Italian patent No. 866,519.

2 - IMIDIZED ACRYLIC POLYMER

| TYPE | COMPOSITION | VISCOSITY in dl/g (f) | TG (°C.) | NITROGEN CONTENT % |
|---|---|---|---|---|
| 2.A(c) | 97.2% by weight of methylmethacrylate 2.8% by weight of methylacrylate, imidized with N-hexadecylamine | 0.57 | −36 | 2.7 |
| 2.B(c) | Polymethylmethacrylate imidized with N-hexadecylamine + | 0.42 | −36.5 | 2.8 |

-continued

| 2 - IMIDIZED ACRYLIC POLYMER | | | | |
|---|---|---|---|---|
| TYPE | COMPOSITION | VISCOSITY in dl/g (f) | TG (°C.) | NITROGEN CONTENT % |
| | ammonium chloride | | | |
| 2.C(c) | 97.9% by weight of methylmethacrylate 2.1% by weight of methylacrylate, imidized with N-hexadecylamine + ammonium chloride | 0.88 | −36 | 2.9 |
| 2.D(c) | Polymethylmethacrylate imidized with N-hexadecylamine, + ammonium chloride | 0.81 | −37.2 | 2.61 |
| 2.E(c) | 97.2% by weight of methylmethacrylate 2.8% by weight of methylacrylate, imidized with N-hexadecylamine | 0.81 | −35 | 2.6 |
| 2.F(d) | 98% by weight of methylmethacrylate 2% by weight of methylacrylate, imidized with N-hexadecylamine | 0.45 | −32.8 | 2.62 |
| 2.G(d) | 98% by weight of methylmethacrylate 2% by weight of methylacrylate, imidized with N-tetradecylamine | 0.36 | −40 | 2.5 |
| 2.H(d) | 98% by weight of methylmethacrylate 2% by weight of methylacrylate, imidized with N-hexadecylamine | 0.62 | −40.7 | 2.5 |
| 2.I(e) | Polymethacrylic acid imidized with N-hexadecylamine, N-octadecylamine e N-tetradecylamine | 0.06 | — | 3.95 |

(c) Prepared according to the process conditions of example 1 of the published European Patent Application No. 315 151.
(d) Prepared according to the process conditions of example 1 of U.S. Pat. No. 2,528,435.
(e) Prepared according to the process conditions of example 1 of French Patent No. 2,528,435.
(f) Determined at 30° C. in tetrahydrofurane.

EXAMPLES 1-50

A mixture of an ethylene copolymer and an imidized acrylic polymer, of the type and in the amounts reported in Table I, was added, in solution at 10% by weight in SOLVESSO 150, to different samples of a gas oil having the following characteristics:

| | |
|---|---|
| Initial boiling temperature = | 179° C. |
| Boiling temperature at 5% by volume = | 215° C. |
| Boiling temperature at 50% by volume = | 278° C. |
| Boiling temperature at 95% by volume = | 374° C. |
| End boiling temperature = | 385° C. |
| Density at 15° C. = | 0.8466 g/cc |
| P.P. = | −6° C. |
| C.F.P.P. = | +2° C. |

In Table 1 the amounts of ethylene copolymer and of imidized acrylic polymer contained in gas oil compositions and the values of P.P. and C.F.P.P. of the so-formulated compositions are reported.

The P.P. was measured according to ASTM D97-66 and the C.F.P.P. according to the IP 309/83.

EXAMPLES 51-83

A mixture of an ethylene copolymer and an imidized acrylic polymer, of the type and in the amounts reported in Table 2, was added, in solution at 10% by weight in SOLVESSO 150, to different samples of a gas oil having the following characteristics:

| | |
|---|---|
| Initial boiling temperature = | 191° C. |
| Boiling temperature at 5% by volume = | 222° C. |
| Boiling temperature at 50% by volume = | 282° C. |
| Boiling temperature at 95% by volume = | 360° C. |
| End boiling temperature = | 370° C. |
| Density at 15° C. = | 0.8595 g/cc |
| P.P. = | −15° C. |
| C.F.P.P. = | −4° C. |

The characteristics of the so-formulated gas oil are reported in Table 2.

EXAMPLES 84-93

A mixture of a ethylene copymer and an imidized acrylic polymer, of the type and in the amounts reported in Table 3, was added, in solution at 10% by weight in SOLVESSO 150, to different samples of a gas oil having the following characteristics:

| | |
|---|---|
| Initial boiling temperature = | 194° C. |
| Boiling temperature at 5% by volume = | 222° C. |
| Boiling temperature at 50% by volume = | 281° C. |
| Boiling temperature at 95% by volume = | 358° C. |
| End boiling temperature = | 369° C. |
| Density at 15° C. = | 0.8449 g/cc |
| P.P. = | −12° C. |
| C.F.P.P. = | −3° C. |

The characteristics of the so-formulated gas oil are reported in Table 3.

In the Tables, the mark (*) relates to the comparison examples.

TABLE I

| EXAMPLE Nr. | TYPE | AMOUNTS | PP (°C.) | CFPP (°C.) |
|---|---|---|---|---|
| 1* | 1.A | 100 | −15 | −2 |
| 2* | 1.A | 175 | −21 | −7 |
| 3* | 1.B | 100 | −12 | −1 |
| 4* | 1.B | 175 | −18 | −5 |
| 5* | 1.C | 100 | −21 | −1 |
| 6* | 1.D | 350 | −12 | −3 |
| 7* | 1.E | 350 | −12 | −1 |
| 8* | 1.F | 100 | −12 | −5 |
| 9* | 1.F | 175 | −12 | −6 |
| 10* | 2.A | 100 | −18 | 0 |
| 11* | 2.A | 175 | −18 | −2 |

TABLE I-continued

| EXAMPLE Nr. | TYPE | AMOUNTS | PP (°C.) | CFPP (°C.) |
|---|---|---|---|---|
| 12* | 2.B | 100 | −12 | −2 |
| 13* | 2.B | 175 | −15 | −1 |
| 14* | 2.B | 350 | −15 | −1 |
| 15* | 2.C | 175 | −12 | 0 |
| 16* | 2.D | 100 | −12 | 3 |
| 17* | 2.D | 175 | −13 | 1 |
| 18* | 2.E | 100 | −15 | 0 |
| 19* | 2.E | 175 | −15 | −1 |
| 20* | 2.F | 100 | −15 | −1 |
| 21* | 2.H | 100 | −15 | −2 |
| 22* | 2.H | 175 | −15 | −2 |
| 23* | 2.I | 100 | −15 | 2 |
| 24 | 1.A | 87.5 | −24 | −16 |
| | 2.A | 87.5 | | |
| 25 | 1.A | 131 | −24 | −18 |
| | 2.A | 44 | | |
| 26 | 1.A | 145 | −24 | −13 |
| | 2.A | 30 | | |
| 27 | 1.A | 50 | −18 | −10 |
| | 2.B | 50 | | |
| 28 | 1.A | 75 | −18 | −10 |
| | 2.B | 25 | | |
| 29 | 1.A | 83 | −18 | −10 |
| | 2.B | 17 | | |
| 30 | 1.A | 131 | −24 | −15 |
| | 2.B | 44 | | |
| 31 | 1.A | 131 | −24 | −17 |
| | 2.C | 44 | | |
| 32 | 1.A | 75 | −18 | −14 |
| | 2.D | 25 | | |
| 33 | 1.A | 131 | −24 | −15 |
| | 2.D | 44 | | |
| 34 | 1.A | 75 | −18 | −10 |
| | 2.E | 25 | | |
| 35 | 1.A | 131 | −24 | −13 |
| | 2.E | 44 | | |
| 36 | 1.A | 75 | −21 | −16 |
| | 2.F | 25 | | |
| 37 | 1.A | 75 | −18 | −14 |
| | 2.H | 25 | | |
| 38 | 1.A | 131 | −24 | −17 |
| | 2.H | 44 | | |
| 39 | 1.A | 75 | −21 | −9 |
| | 2.I | 25 | | |
| 40 | 1.B | 75 | −21 | −10 |
| | 2.A | 25 | | |
| 41 | 1.B | 75 | −18 | −10 |
| | 2.B | 25 | | |
| 42 | 1.B | 131 | −21 | −15 |
| | 2.B | 44 | | |
| 43 | 1.B | 131 | −21 | −16 |
| | 2.E | 44 | | |
| 44 | 1.C | 75 | −24 | −13 |
| | 2.A | 25 | | |
| 45 | 1.C | 75 | −24 | −13 |
| | 2.E | 25 | | |
| 46 | 1.D | 262.5 | −18 | −11 |
| | 2.B | 87.5 | | |
| 47 | 1.E | 262.5 | −27 | −11 |
| | 2.B | 87.5 | | |
| 48 | 1.F | 25 | −21 | −14 |
| | 2.A | 75 | | |
| 49 | 1.F | 44 | −21 | −15 |
| | 2.A | 131 | | |
| 50 | 1.F | 44 | −18 | −12 |
| | 2.B | 131 | | |

TABLE 2

| EXAMPLE Nr. | TYPE | AMOUNTS | PP (°C.) | CFPP (°C.) |
|---|---|---|---|---|
| 51* | 1.A | 50 | −18 | −8 |
| 52* | 1.A | 100 | −21 | −11 |
| 53* | 1.A | 175 | −21 | −12 |
| 54* | 1.B | 100 | −18 | −10 |
| 55* | 1.B | 175 | −21 | −13 |
| 56* | 1.C | 50 | −15 | −10 |
| 57* | 1.C | 100 | −18 | −11 |

TABLE 2-continued

| EXAMPLE Nr. | TYPE | AMOUNTS | PP (°C.) | CFPP (°C.) |
|---|---|---|---|---|
| 58* | 1.C | 175 | −21 | −12 |
| 59* | 2.A | 50 | −18 | −5 |
| 60* | 2.A | 100 | −18 | −4 |
| 61* | 2.A | 175 | −18 | −4 |
| 62* | 2.B | 100 | −15 | −6 |
| 63* | 2.B | 175 | −18 | −8 |
| 64* | 2.C | 175 | −18 | −4 |
| 65* | 2.E | 100 | −18 | −6 |
| 66* | 2.E | 175 | −18 | −7 |
| 67 | 1.A | 37.5 | −24 | −16 |
| | 2.A | 12.5 | | |
| 68 | 1.A | 75 | −24 | −16 |
| | 2.B | 25 | | |
| 69 | 1.A | 83 | −24 | −16 |
| | 2.B | 17 | | |
| 70 | 1.A | 131 | −27 | −20 |
| | 2.B | 44 | | |
| 71 | 1.A | 146 | −24 | −19 |
| | 2.B | 29 | | |
| 72 | 1.A | 131 | −24 | −20 |
| | 2.C | 44 | | |
| 73 | 1.A | 131 | −24 | −15 |
| | 2.E | 44 | | |
| 74 | 1.B | 75 | −24 | −17 |
| | 2.A | 25 | | |
| 75 | 1.B | 131 | −24 | −20 |
| | 2.A | 44 | | |
| 76 | 1.B | 75 | −24 | −13 |
| | 2.B | 25 | | |
| 77 | 1.B | 131 | −24 | −20 |
| | 2.B | 44 | | |
| 78 | 1.B | 75 | −24 | −16 |
| | 2.E | 25 | | |
| 79 | 1.C | 97.5 | −21 | −17 |
| | 2.A | 12.5 | | |
| 80 | 1.C | 75 | −24 | −19 |
| | 2.A | 25 | | |
| 81 | 1.C | 75 | −24 | −17 |
| | 2.B | 25 | | |
| 82 | 1.C | 131 | −27 | −21 |
| | 2.B | 44 | | |
| 83 | 1.C | 75 | −24 | −16 |
| | 2.E | 25 | | |

TABLE 3

| EXAMPLE Nr. | TYPE | AMOUNTS | PP (°C.) | CFPP (°C.) |
|---|---|---|---|---|
| 84* | 1.A | 175 | −18 | −9 |
| 85* | 1.A | 350 | −21 | −14 |
| 86* | 2.A | 350 | −18 | −8 |
| 87* | 2.B | 175 | −18 | −8 |
| 88* | 2.G | 175 | −24 | 0 |
| 89* | 2.G | 350 | −24 | −3 |
| 90 | 1.A | 291 | −24 | −17 |
| | 2.A | 59 | | |
| 91 | 1.A | 87.5 | −21 | −16 |
| | 2.B | 87.5 | | |
| 92 | 1.A | 131 | −27 | −16 |
| | 2.G | 44 | | |
| 93 | 1.A | 262.5 | −30 | −19 |
| | 2.G | 87.5 | | |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A refined liquid hydrocarbon composition endowed with improved behavior at low temperatures, comprising from 0.005 to 1% by weight of a mixture comprising:

(i) a copolymer of ethylene with at least another copolymerizable monomer, and (ii) an imidized acrylic polymer, whereby said mixture of (i) and (ii) decreases the pour point and cold filter plugging point of the refined liquid hydrocarbon composition.

2. Composition according to claim 1, wherein the ratio by weight between the ethylene copolymer and the imidized acrylic polymer is between 0.1 and 10.

3. Composition according to claim 1, wherein the ethylene copolymer has an ethylene content between 1 and 99% by mol, and it is selected from the group consisting of:

a) oil-soluble copolymer constituted by ethylene and a $C_3$–$C_{18}$ alpha-olefin, including ethylene-propylene copolymer;

b) oil-soluble terpolymer constituted by ethylene, a $C_3$–$C_{18}$ alpha-olefin and an aliphatic or cycloaliphatic diene, including ethylene-propylene-methylenenorbornene terpolymer, ethylene-propylene-5-ethylidene-2-norbornene terpolymer, ethylene-propylene-1,4-hexadiene terpolymer, ethylene-propylenedicyclopentadiene terpolymer, ethylene-propylenebutadiene terpolymer;

c) the ethylene -$C_3$–$C_{18}$ alpha-olefin copolymers or the ethylene-alpha-olefin-diene degraded and oxidized by treatment with oxygen or with an oxygen containing gas at a temperature greater than 100° C., and optionally reduced;

d) the copolymers containing ethylene and at least a polar monomer such as an unsaturated acid, an unsaturated anhydride or a mono- or di-ester of an unsaturated acid of formula:

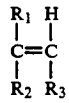

(I)

wherein:

$R_1$ is hydrogen or methyl;

$R_2$ is a —$OOCR_4$ or —$COOR_4$ radical, wherein $R_4$ is hydrogen or an $C_1$–$C_{16}$ straight or branched alkyl radical, and $R_3$ is hydrogen or a —$COOR_4$ radical, $R_4$ having the above reported meaning;

e) the terpolymers containing 35–98% of ethylene, 1–5% of propylene and 1–60% of an alkyl ester of acrylic or methacrylic acid having from 1 to 12 C in the alkyl chain;

f) the reaction products of the maleic anhydride and an ethylene-propylene-diene terpolymer.

4. Composition according to claim 1, wherein the copolymer of ethylene with another copolymerizable monomer is a copolymer of is a copolymer of ethylene with propylene, or a terpolymer of ethylene with propylene and a conjugated diolefin, said copolymer and terpolymer being characterized in that they contain from 20 to 55% by weight of propylene, and from 0 to 10% by weight of monomeric units deriving from such a diolefin, and by values of at least one of $X_2$ and $X_4$ parameters, wherein $X_2$ and $X_4$ represent the fraction of methylenic sequences containing uninterrupted sequences of respectively 2 and 4 methylene groups between two successive methyl or methyne groups in the polymeric chain and which are equal to, or lower than, about 0.02.

5. Composition according to claim 1, wherein both $X_2$ and $X_4$ parameters of the copolymer or terpolymer are equal to, or lower than, about 0.02.

6. Composition according to claim 4, wherein the conjugated diolefin is butadiene.

7. Composition according to claim 4, wherein the ethylene copolymers and terpolymers have a viscosimetric molecular weight within the range of from 1,000 to 200,000.

8. Composition according to claim 4, wherein the ethylene copolymers or terpolymers are degraded at temperatures of at least 100° C., and have a content of >C=O groups within the range of from 0 to 10 per each 1,000 carbon atoms.

9. Composition according to claim 1, wherein the imidized acrylic polymer has imide units of formula:

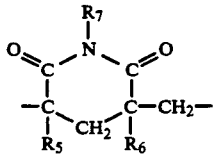

(IV)

wherein:

$R_5$ and $R_6$, either equal to or different from each other, represent hydrogen or an alkyl, aryl, arylalkyl or alkylaryl radical containing from 1 to 20 carbon atoms;

$R_7$ represents an alkyl, cycloalkyl, aryl, arylalkyl or alkylaryl radical containing from 4 to 30 carbon atoms; $R_5$ and $R_6$ being derived from esters of acrylic or methacrylic acid and $R_7$ from a primary amine or a secondary amide.

10. Composition according to claim 9, wherein the acrylic polymer is a homopolymer or a copolymer of acrylic or methacrylic acid or alkyl esters thereof, wherein the alkyl group contains from 1 to 20 carbon atoms.

11. Composition according to claim 9, wherein the acrylic polymer is imidized by reaction with a nitrogen-containing compound, including alkylamine, or a compound having formula:

$$R_8—X—NHR_7 \quad (V)$$

wherein:

$R_8$ can be hydrogen or an alkyl, cycloalkyl, aryl or alkylaryl radical containing from 1 to 20 carbon atoms;

$R_7$ can be an alkyl, cycloalkyl, aryl, arylalkyl or alkylaryl radical containing from 4 to 30 carbon atoms; and X is a bifunctional radical selected from the group consisting of: —CO—, —CONH—, —OCO—, —$SO_2$—, —$C_6H_4SO_2$—.

12. composition according to claim 1, wherein the mixture of the ethylene copolymer (i) and of the imidized acrylic polymer (ii) is added in concentrate solution containing from 5 to 70% by weight of said mixture.

13. Composition according to claim 12, wherein the solvent is constituted by hydrocarbons and/or their blends, having an aromatic, paraffinic, naphthenic character.

14. Composition according to claim 1, containing in addition antioxidant agents, basic detergents, corrosion inhibitors, rust inhibitors, and/or cloud-point depressants.

15. Composition according to claim 2, wherein the ratio is between 0.25 and 4.

16. Composition according to claim 3, wherein $R_4$ is a $C_1$–$C_4$ straight or branched alkyl radical.

17. Composition according to claim 4, wherein said copolymer and terpolymer containing from 25 to 45% by weight of propylene and from 1 to 7% by weight of monomeric units deriving from such a diolefin.

18. Composition according to claim 7, wherein the molecular weight is from 3,000 to 150,000.

19. Composition according to claim 10, wherein the alkyl contains from 1 to 8 carbon atoms.

20. Composition according to claim 11, wherein the nitrogen containing compound has a carbon atom number greater than 4.

21. A refined liquid hydrocarbon composition endowed with improved behavior at low temperatures, comprising from 0.005 to 1% by weight of a mixture comprising:

(a) an imidized acrylic polymer and a copolymer of ethylene with propylene, or (b) an imidized acrylic polymer and a terpolymer of ethylene with propylene and a conjugated diolefin, wherein said copolymer and terpolymer being characterized in that they contain from 20 to 55% by weight of propylene, and (b) contains up to 10% by weight of a conjugated diolefin monomeric unit, and by values of at least one of $X_2$ and $X_4$ parameters, wherein $X_2$ and $X_4$ represent the fraction of methylenic sequences containing uninterrupted sequences of respectively 2 and 4 methylene groups between two successive methyl or methyne groups in the polymeric chain and which are equal to, or lower than, about 0.02, whereby mixture (a) or (b) decreases the pour point and cold filter plugging point of the refined liquid hydrocarbon composition.

* * * * *